United States Patent [19]

Johnson

[11] 4,148,473

[45] Apr. 10, 1979

[54] APPARATUS FOR HANDLING STACKS OF FLAT ARTICLES SUCH AS BAG-FORMING TUBES AND FOR SEPARATING AND DELIVERING THE SAME INDIVIDUALLY

[76] Inventor: Harold K. Johnson, Rte. 3, Box 26, Junction City, Kans. 66441

[21] Appl. No.: 782,883

[22] Filed: Mar. 30, 1977

[51] Int. Cl.[2] ..... B65H 3/08; B65H 1/18; B65H 3/54

[52] U.S. Cl. ..... 271/20; 198/461; 271/12; 271/31; 271/155; 271/157; 414/121

[58] Field of Search ..... 271/20, 11, 12, 13, 271/14, 15, 16, 17, 30 R, 31, 157, 152–156, 147, 269, 270, 107; 198/461, 859, 487; 214/8.5 A, 8.5 D

[56] References Cited

U.S. PATENT DOCUMENTS

| | | | |
|---|---|---|---|
| 1,029,159 | 6/1912 | Westerbeck | 271/269 X |
| 2,525,189 | 10/1950 | Thomas | 198/461 |
| 2,588,582 | 3/1952 | Sivertson | 271/14 X |
| 2,588,845 | 3/1952 | Kaderavek | 198/859 X |
| 2,665,633 | 1/1954 | Schubert | 214/8.5 A |
| 2,912,240 | 11/1959 | Frankle et al. | 271/20 |
| 3,201,114 | 8/1965 | Swartz et al. | 271/11 |
| 3,638,538 | 2/1971 | Sullivan | 198/422 X |
| 3,887,178 | 6/1975 | Fujimoto | 271/30 R |
| 4,033,578 | 7/1977 | Taylor et al. | 271/157 |

*Primary Examiner*—Bruce H. Stoner, Jr.

*Attorney, Agent, or Firm*—Schmidt, Johnson, Hovey & Williams

[57] ABSTRACT

An apparatus and method for handling, separating and feeding gusset tubes from stacks thereof is provided which allows continuous, high speed separation and feeding of individual tubes without sagging or hangup problems, and at high operational speeds. The apparatus includes a pickup and feeding mechanism having tube-engaging arms, vacuum tube grippers for positively forming a bowed section in the tubes as they are lifted and upright stop structure for preventing shifting movement of the tube stack at the pickup station and separating any underlying tubes which may adhere to the topmost tube being fed. Stack elevating and lowering apparatus includes electrically controlled lifting mechanism having a pair of interconnected clutch elements for control of vertical movement. A conveying assembly having incrementally driven stack-supporting belts and pusher arms shiftable at a speed different than the belts serves to feed successive stacks to the pickup and feeding mechanism.

17 Claims, 15 Drawing Figures

-40-
20
22
24
32
34
36
44
46
48
50
54
56
58
60
64
66
68
74
76
78
80
88
90
92
94
130
132
134
138
140
142
144
148
150
152
154
156
158
160
162
163
166
167
174
176
180
184
186
188
190
192
228
230
232
234
236
238
242

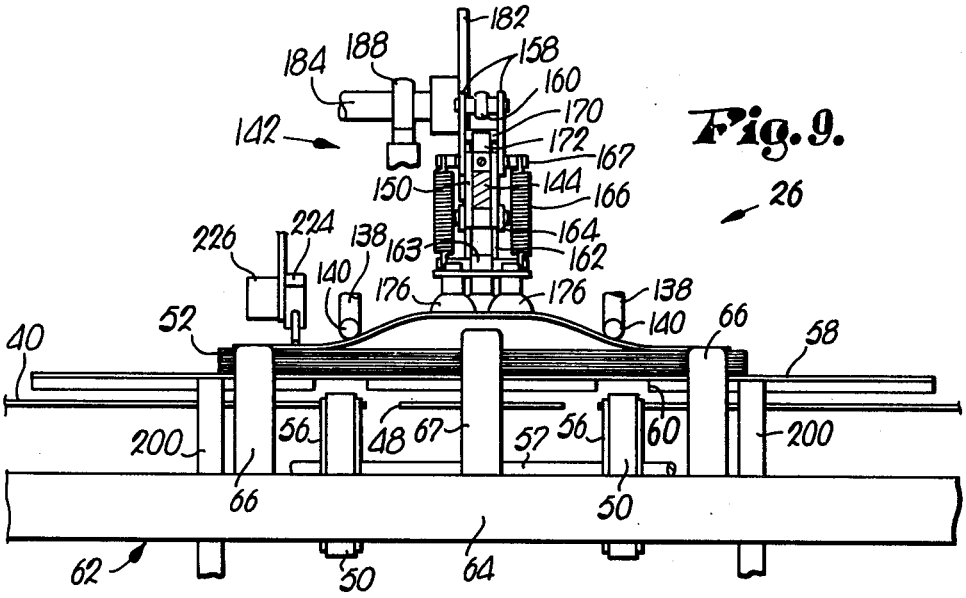
Fig. 9.
Fig. 10.
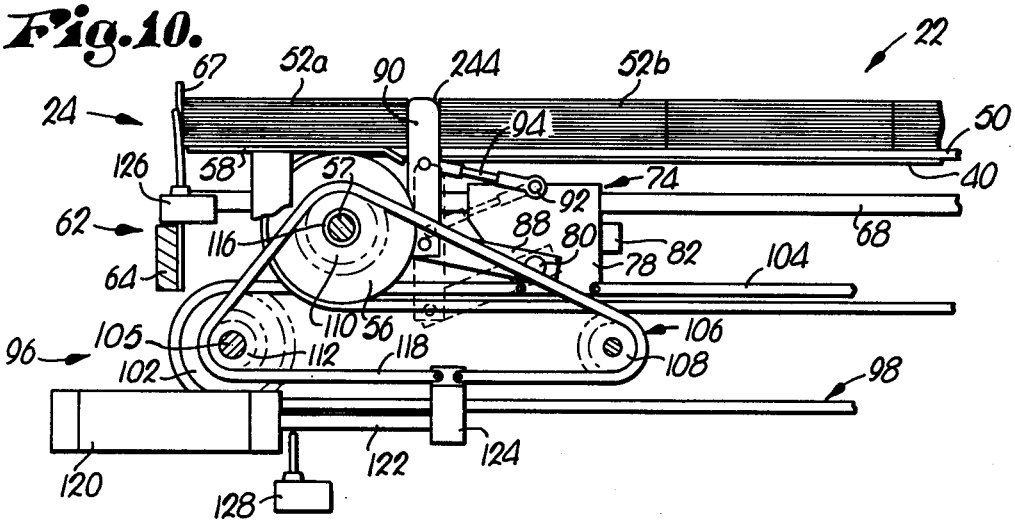
Fig. 11.
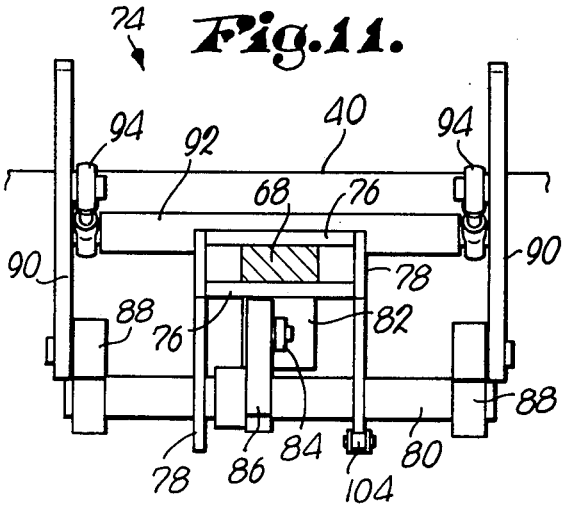
Fig. 12.
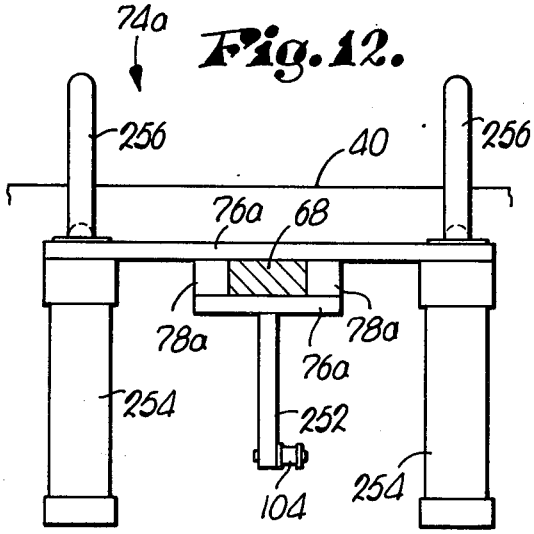

APPARATUS FOR HANDLING STACKS OF FLAT ARTICLES SUCH AS BAG-FORMING TUBES AND FOR SEPARATING AND DELIVERING THE SAME INDIVIDUALLY

This invention relates to apparatus for individually handling, separating and feeding bag-forming tubes or the like from stacks thereof at very high rates of speed. More particularly, it is concerned with such apparatus which includes a number of specific features which allow the unit to essentially automatically handle stacks of such tubes, including those of either the flat fold or the gusset types, and individually feed the latter for further processing or filling.

Producers of bulk packaged goods often package, ship and store their products in elongated, multiple-ply bags. Bulk packaged pet foods and lawn and garden supplies are but two examples that readily come to mind. One type of bag popular for these uses is the so-called gusset bag which comprises separate main panels interconnected by folded pleats which define the side margins of the bag. These gusset bags, by virtue of the side pleats, can be stored in a relatively flat condition and thereafter expanded and filled with a desired product. Of course, flat fold type large bags can also be used for these purposes.

In any event, manufacturers and users of large bags generally employ automated machinery for handling the same. In the case of bag manufacturers, stacks of open ended tubes must normally be handled, separated and fed individually for further manufacturing steps such as providing a sealed bottom for the tubes of thus present fillable bags.

While devices have been proposed in the past for automated handling stacks of gusset tubes or bags, a number of heretofore unresolved problems have presented major obstacles. The most prominent of these problems is that the prior handling devices have generally been unable to successfully separate and feed gusset tubes or bags at high rates of speed (e.g. 100 tubes per minute or greater). The primary difficulty in this regard is that gusset tubes have a tendency to spread or sag at the gussets thereof during handling and thus cause machinery jam-ups. In other instances separate tubes may adhere to one another and make it difficult to quickly separate the tubes for individual feeding. Finally, the inherent relative stiffness of multiple-ply bags sometimes creates problems in handling.

Different methods have heretofore been employed to lock gusset tubes or bags during handling so as to prevent spreading of the marginal gussets. The most common technique is to bow the tubes by lifting each of the same at the central area thereof by means of suction cups or the like. Although bowing of the tubes does solve the problem of gusset spreading, prior devices designed to accomplish this purpose have either been very complex and therefore costly, or unable to operate at high production rates. Another prior suggestion has been to bow a complete stack of tubes and thereafter pick the tubes up individually in a bowed condition. These types of devices are also plagued by the problems of relative costliness or inefficiency.

Other problems associated with conventional tubes or bag-handling equipment involves the apparatus provided for conveying respective stacks of tubes to be picked up, and for maintaining the stack in a proper relationship to the pickup equipment as individual bags are removed therefrom. For example, when tubes are being handled at rates of over 100 per minute, it is difficult to transfer separate stacks of tubes without causing disruption or shifting between adjacent stacks, or jamming of the tubes thereof together when they are stopped. That is, it is a common practice to provide conveyor means for sequentially shifting an aligned series of stacks into a pickup station associated with the overall handling apparatus; and the momentum of the stacks as they are being moved oftentimes causes undesirable relative shifting between the tubes in adjacent stacks, with consequent disruption thereof and interference between stacks.

It is also generally necessary to provide level control for a stack of tubes at the pickup station. In other words, as individual tubes are removed from the stack, some means should be provided for incrementally elevating the stack so that the topmost member thereof is at a desired pickup level. Without such a capability, the pickup unit itself must be variably shiftable to compensate for the decreased height of the stack. While this alternative may be possible, the complex structure necessary may drastically increase costs or make it very difficult to properly time the operation of the pickup equipment relative to the operation of the overall apparatus.

It is therefore the most important object of the present invention to provide apparatus for effective, high-speed handling, separation and feeding of flat tubes or bags such as gusset tubes from stacks thereof, notwithstanding virtual elimination of problems heretofore encountered in connection with handling of tubes of this type, such as sagging of the tubes, improper or incomplete separation of the latter, interference or mixing of tubes between adjacent stacks, and improper level control of the stacks as individual tubes are removed.

A more specific aim of the present invention is to provide tube or bag handling equipment which includes simplified apparatus for individually and sequentially shifting the flat tubes from a stack thereof which includes structure presenting a pair of elongated, spaced, tube-engaging surface above the stack, along with means for individually picking up the tubes from the stack and causing the same to engage the surfaces in order to quickly and positively form a bow in the tube which prevents gusset-sagging; in preferred forms, the apparatus also includes upstanding stack-engaging stop structure which precludes shifting movement of the stack itself during the pickup operation, and is of a height for assuring separation of any tubes adhering to the topmost tube being handled, as the latter passes over the upstanding structure in a bowed condition.

As a corollary to the foregoing, another object of the invention is to provide a method of individually separating generally flat, flexible articles such as tubes or bags from a stack thereof, and shifting the separated articles away from the stack, which includes the steps of positioning the stack against a structural element for normally preventing movement of the stack, lifting at least a portion of the topmost article away from the stack and positively forming a bowed section therein, and thereafter shifting the bowed section over the structural element and away from the stack for assuring separation of any adhering articles to that being handled.

Another object of the invention is to provide apparatus for selectively shifting a series of generally aligned, adjacent articles such as a stack of flat tubes or the like to a handling station which includes shiftable conveyor means supporting the series of articles and defining a path of travel therefor, along with an article-engaging pusher member mounted for back-and-forth travel generally with the shiftable means, and mechanism for selectively shifting the latter and the article-engaging member at respective rates of travel for moving the articles forwardly towards the handling station and displacing the leading article toward the handling station and away from the adjacent article in the series, for creating an operating space between the leading article and that adjacent thereto; in this fashion a smooth pickup or handling operation is assured, since the space between the adjacent stacks precludes intereference therebetween.

A still further object of the invention is to provide selectively operable, sensor-controlled stack elevating apparatus for moving a stack of articles vertically from an initial level in response to removal of articles therefrom, so that the topmost article of the stack is maintained at the desired pickup or handling level; the apparatus preferably includes a vertically shiftable stack-supporting staton along with drive means having a pair of operably interconnected, force-transmitting clutch elements, and means for controlling the respective clutch elements in a manner to incrementially elevate the stack station as individual articles are removed from the stack, and for allowing the stack supporting station to descend to its rest position when all of the articles of the stack have been removed.

In the drawings:

FIG. 9 is a fragmentary front elevational view of the apparatus illustrated in FIGS. 1 and 3, shown during the operation thereof in forming a central bowed section in the topmost tube of the stack;

FIG. 10 is a fragmentary side elevational view illustrating the operation of the stack-conveying portion of the invention as a fresh stack of tubes is fed to the pickup station and a space is created between the leading stack and second stack in the series;

FIG. 11 is an enlarged front elevational view illustrating the details of the stack-engaging pusher mechanism;

FIG. 12 is an enlarged front elevational view of an alternate form of a stack-engaging pusher mechanism;

FIG. 14 is a fragmentary side elevational view of an alternate form of the drive mechanism for the stack-conveying portion of the overall apparatus.

Figures 1, 1A, 2:
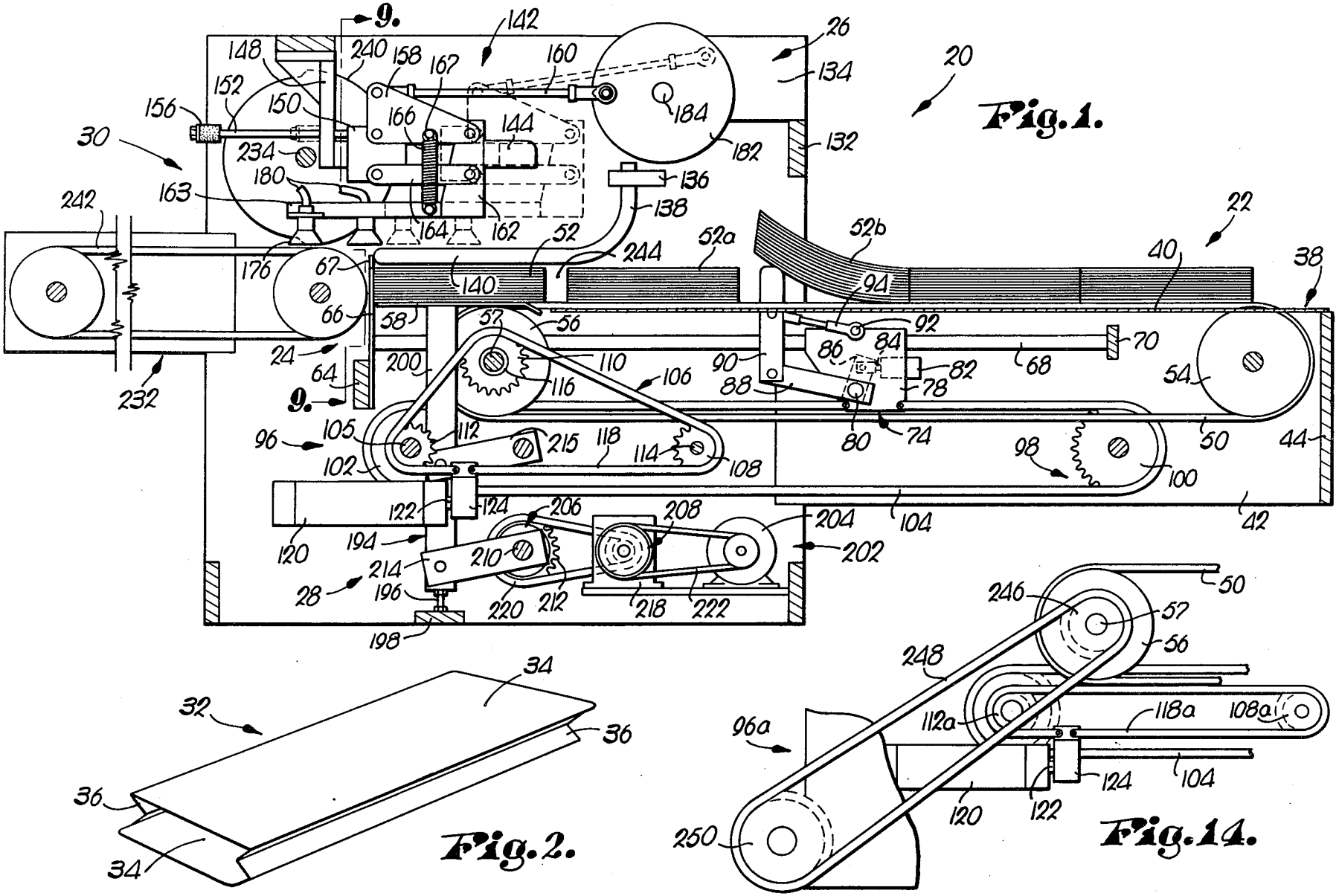
FIG. 1 is a fragmentary vertical sectional view of the overall apparatus of the present invention for handling, separating and feeding individual articles such as flat gusset tubes from respective stacks thereof.
FIG. 2 is a perspective view of a conventional gusset tube of the type which can be advantageously handled by the apparatus of the invention.

Turning now to the drawings, overall tube or bag handling, separating and feeding apparatus 20 broadly includes a stack-conveying assembly 22 leading to a pickup station 24, along with tube-gripping and shifting structure 26 disposed generally above the latter. An elevating assembly 28 is also provided for selectively shifting pickup station 24 vertically in a manner to be explained hereinafter. Finally, an article-receiving assembly 30 is provided adjacent station 24 for receiving individual tubes or the like as they are fed by shifting structure 26.

Although forming no specific part of the present invention, it is to be understood that apparatus is especially adapted for handling, separating and feeding so-called gusset tubes 32 (see FIG. 2). Such gusset tubes include respective, opposed main panels 34 interconnected by folded marginal pleats or gussets 36. In the FIG. 2 illustration, a true gusset tube is shown having open ends; it is of course clear that apparatus 20 is equally usable in connection with fillable gusset bags having one end thereof closed. Moreover, other types of flat, generally planar, flexible articles, such as other types of tubes or bags, can also be handled by apparatus 20. In general, such articles or tubes are provided in stacks and it is necessary to handle, separate and feed the respective articles from the stacks for delivery to additional handling or processing stations. For example, in the case of gusset tubes, it is generally necessary to process tube stacks for individual feeding of the tubes to a station for closing one end of the tubes to present gusset bags.

Figures 3, 13:
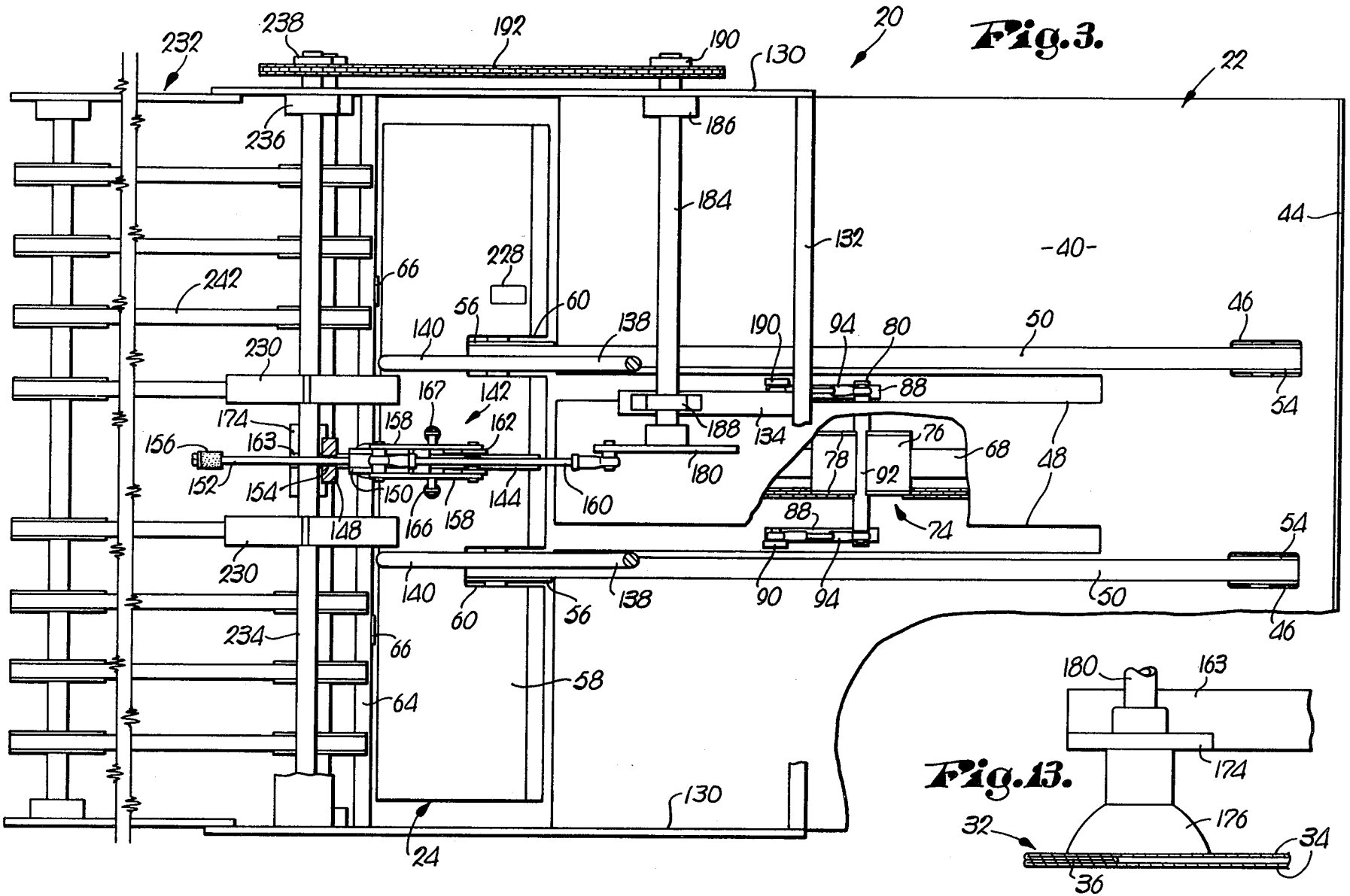
FIG. 3 is a fragmentary plan view of the apparatus illustrated in FIG. 1.
FIG. 13 is an enlarged, fragmentary view illustrating the gripping engagement between the suction cups of the tube-gripping mechanism and a gusset tube being handled and fed.

Conveying assembly 22 includes an elongated conveying table 38 having a planar, slotted, generally horizontally disposed upper surface 40, along with depending marginal sidewalls 42 and a rear wall 44. Upper surface 40 is provided with a pair of parallel, pulley-receiving openings 46, along with a pair of elongated, laterally spaced, pusher arm-receiving slots 48 (FIG. 3) which are located in the space between the openings 46. As best seen in FIG. 3, the forward edge of table 38 is adjacent the receiving or rearward edge of pickup station 24.

A pair of endless conveyor belts 50 are provided which respectively extend through the openings 46 and engage and are supported by surface 40. As shown, the belts 50 movably support an aligned series of stacks 52 of gusset tubes or other articles to be handled. A pair of laterally spaced, interconnected pulleys 54 are respectively located partially within the openings 46 and support the individual belts 50 in the usual manner. Similarly, a pair of spaced, interconnected pulleys 56 are provided at the forward ends of the belts 50, and are mounted on a transversely extending shaft 57. In the usual fashion, the belts 50 are trained around the pulleys 54 and 56, and powered rotation of the pulleys causes the belts to move and define a path of travel for the stacks 52.

Pickup station 24 is in the form of a vertically shiftable, generally planar shelf or plate 58 having a pair of spaced, pulley-receiving slots 60 extending from the rearward edge thereof. As best seen in FIGS. 1 and 3, the belt-supporting pulleys 56 are partially within the slots 60, and correspondingly, the belts 50 extend into and slightly above the upper surface of shelf 58. Station 24 further includes upright, stack-engaging stop structure 62 which has a horizontally extending support beam 64 along with a pair of upright, laterally spaced side stops 66, and a somewhat higher central stop 67. The stops 66 and 67 are connected to beam 64 and extend vertically above the initial operating level of the shelf 58. The side stops 66 are located adjacent the forward edge of the shelf 58 and are adapted to abut and prevent shifting of a stack of articles within pickup station 24; moreover, central stop 67 prevents carryover of tubes or bags adhering to the topmost tube or bag being gripped.

An elongated, centrally disposed, generally rectangular slide bar 68 is mounted beneath upper surface 40. Bar 68 is connected at the respective ends thereof to a crosspiece 70 extending between the sidewalls 42, and to central stop 67 of stop structure 62. A selectively actuatable pusher mechanism 74 is slidably disposed on bar 68 (see FIG. 11) and includes a pair of spaced, horizontal body plates 76 located respectively above and below bar 68, along with a pair of depending sidewalls 78. A lowermost shaft 80 extends through and beyond the sidewalls 78 and is rotatably mounted therein. A conventional piston and cylinder assembly 82 is supported between the sidewalls 78 and has the piston rod 84 thereof pivotally connected to a pivotal, motion-transmitting block 86. Block 86 is in turn secured to shaft 80 so that upon extension of rod 84, shaft 80 is rotated through the medium of block 86.

A pair of generally forwardly extending linkage arms 88 are respectively coupled to the opposed ends of shaft 80. A pair of upwardly extending stack-engaging pusher arms 90 are respectively coupled to the outermost ends of the linkage arms 88. Finally, a second, transversely extending shaft 92 is rigidly supported by the sidewalls 78 above bar 68. A pair of parallel linkage arms 94 are in turn pivotally interconnected between the opposed ends of shaft 92 and the adjacent upright pusher arms 90, so as to form a parallel linkage assembly with the linkage arms 88. Referring to FIG. 3, it will be seen that pusher mechanisms 74 and slide bar 68 are located beneath surface 40 such that the vertically shiftable pusher arms 90 can extend upwardly through the slots 48 and travel therealong. The significance of this construction will be explained hereinafter.

Drive means broadly referred to by the numeral 96 (see FIG. 1) is provided for shifting the belts 50 along with pusher mechanism 74 at respective rates of travel. Drive means 96 include a first roller chain assembly 98 having respective sprockets 100 and 102, along with a roller chain 104 therearound. As shown, the sprocket 102 is mounted on a transverse shaft 105. The adjacent ends of chain 104 is operatively connected to the proximal sidewall 78 of pusher mechanism 74 so that the latter is shifted along the length of bar 68 when the roller chain 104 is moved.

Drive means 96 also includes a second roller chain assembly 106 which has three sprockets 108, 110 and 112. Sprocket 108 is mounted on a transverse shaft 114 beneath surface 40, while sprocket 110 is mounted on the outer end of support shaft 57 for the pulleys 56, and sprocket 112 is mounted on shaft 105. In the case of sprocket 110, a conventional one-way clutch element 116 is employed to operatively couple the latter and shaft 57. A length of roller chain 118 is trained around the sprockets 108, 110 and 112. Viewing FIG. 1, the clutch element 116 serves to transmit torque when chain 118 is moving in a counterclockwise direction in order to thus rotate shaft 57 and thereby the pulleys 56 and belts 50; on the other hand, when chain 118 moves in a clockwise direction, element 116 slips and thereby does not transmit torque to the shaft 57.

A selectively actuatable, conventional, pneumatic piston and cylinder unit 120 is mounted adjacent sprocket 112 and has the piston rod 122 thereof connected to a block 124. The latter is in turn coupled to the roller chain 118 so that extension of the rod 122 causes the chain 118 to move around the associated supporting sprockets in a generally counterclockwise fashion; conversely, retraction of the rod 122 moves chain 118 in a clockwise direction.

A pair of conventional limit switches 126 and 128 also form a part of conveying assembly 22. Referring specifically to FIG. 10, it will be seen that switch 126 is mounted adjacent the forward edge of shelf 58, while switch 128 is located proximal to the assembly 120. These switches are operatively coupled by conventional circuitry (not shown) to the respective assemblies 62 and 120 for control of the overall drive assembly. This operation will be described in detail hereinafter.

Structure 26 includes a pair of spaced, upright sidewalls 130 which extend the full height of apparatus 20 and above surface 40. A rearmost crosspiece 132 extends between the sidewalls 130 in order to rigidify the latter. In addition, a support plate 134 extends forwardly from crosspiece 132 at approximately the midpoint of the latter. Finally, the frame assembly for structure 26 also has a secondary crosspiece 136 which is spaced from the rearmost edge of the sidewalls 130.

The operating portion of structure 26 includes a pair of somewhat J-shaped, stationary, tube-engaging bars 138 which are secured to crosspiece 136 and have an elongated portion 140 generally horizontally disposed above plate 58 and the pulleys 56 (see FIG. 1). It will be noted that the top of the central stop 67 extends above the lower surface of the portions 140 of the bars 138.

Figure 5:
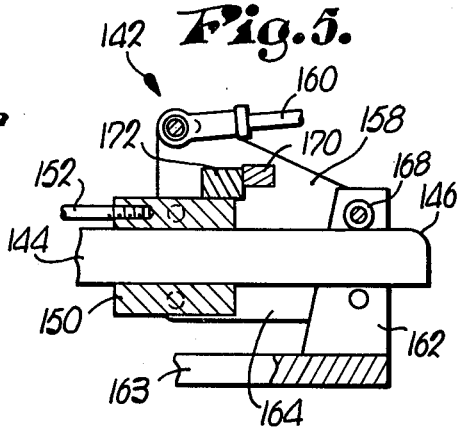
FIG. 5 is a sectional view taken along 5–5 of FIG. 4 and further illustrating the details of construction of the tube-gripping mechanism.
Figure 4:
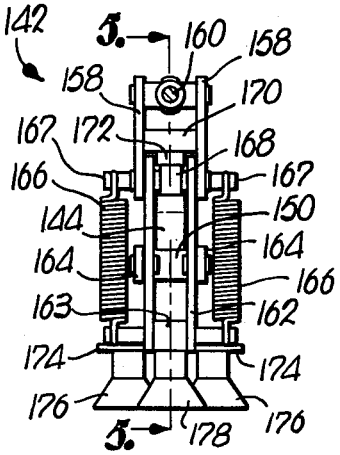
FIG. 4 is a rear elevational view of the tube-gripping mechanism forming a part of the invention.

As best seen in FIGS. 1, 4 and 5, structure 26 further includes mechanism 142 for gripping the topmost tube of the stack within station 24, raising the tube in opposition to the portions 140 to form a bowed section in the gripped tube, and for shifting the tube out of the station 24. The mechanism 142 includes an elongated slide bar 144 having a rounded rearmost upper corner 146. Slide bar 144 is secured midway between sidewalls 130 by means of conventional bracing structure 148 (see FIG. 1). A slide block 150 is shiftably mounted on bar 144 and includes a forwardly projecting guide arm 152. Arm 152 extends through an aperture 154 provided in bracing structure 148, and has a resilient movement-limiting pad 156 on the outermost end thereof.

As shown in FIG. 5, arm 152 is threaded into block 150, and thus the arm 152 can be threadably advanced or retracted as desired. This in turn serves to alter the effective length of the arm 152 relative to the block 150. A pair of spaced, identical, generally triangular linkage segments 158 are pivotally coupled to block 150 adjacent the upper end thereof. A drive or crank arm 160 is in turn pivotally connected between the elements 158 at the opposed apices thereof closest to the block mounting points. Finally, the elements 158 are pivotally connected adjacent the remaining apices thereof to the uppermost end of a generally L-shaped gripper-supporting arm 162. The latter includes a pair of spaced upright arms which are disposed for receiving bar 144 therebetween, and a generally horizontal portion 163. A secondary link 164 is pivotally connected at the opposed ends thereof to block 150 and arm 162. Also, a pair of side-by-side helical springs 166 are interconnected between the elements 158 and the generally horizontal portion 163 of the arm 162 for biasing the latter upwardly. As best seen in FIG. 4, a pair of transverse pins 167 are respectively attached to each of the elements 158 and serve to support the springs 166. In order to facilitate sliding movement of block 150 and arm 162 along the length of bar 144, a roller 168 is interconnected between the upright arms of arm 162. This roller is adapted to engage the upper surface of bar 144.

Block-engaging element 170 is connected between the linkage elements 158 and, as best seen in FIG. 5, serves to engage the block 172 (permanently attached to the top of slide block 150) when the elements 158 are generally horizontally disposed. The purpose of block 172 and element 170 is to ensure that the pickup structure does not pivot or rise above the position as illustrated in FIG. 1 during the operational sequences of structure 26, as will be explained.

As noted, generally L-shaped arm 162 includes an elongated, substantially horizontally disposed portion 163. The latter has a pair of laterally extending tabs 174 adjacent the forward end thereof which respectively support a conventional vacuum gripper 176. In addition, an identical gripper 178 is supported on the main body of portion 163 in order to present a clustered, generally triangular array of grippers. These gripping elements 176 and 178 are coupled by lines 180 to a conventional negative pressure-inducing blower (not shown).

Crank arm 160 is pivotally coupled at the end thereof remote from the elements 158 to a circular drive or crank wheel 182. As best shown in FIG. 3, wheel 182 rotates about an axis defined by transverse shaft 184, the latter being supported by bearing structures 186 and 188. Shaft 184 extends outwardly through one of the sidewalls 130 and has a drive sprocket 190 coupled to the outermost end thereof. A timing chain 192 is trained around sprocket 190. In addition, drive means (not shown) is operatively coupled to chain 192 for powered rotation thereof.

Elevating assembly 28 is provided for vertically shifting pickup station 24 as successive articles are removed from the stack supported thereby. In addition, the assembly 28 allows the station 24 to descend back to its initial starting level when all of the articles from the supported stack are removed. In detail, elevating assembly 28 includes an upright, vertically shiftable telescopic shaft 194 which is connected to and supports the shelf 58. Shaft 194 includes a lower, threaded adjustable loop 196 which is supported on and engages a lower cross member 198 (see FIG. 1). Shaft 194 also includes a tubular section 200 which is welded or otherwise permanently affixed to the underside of shelf 58.

Selectively actuatable drive means 202 is provided for shifting shelf 58 through the medium of shaft 194. Means 202 includes an electric motor 204 along with first and second interconnected pneumatic clutch elements 206 and 208. Clutch element 206 is mounted on a transverse shaft 210 and is operatively connected to a sprocket 212. A link 214 is operatively coupled between shaft 210 and section 200 of shaft 194. A secondary link 215 is coupled to section 200 above link 214, so as to define a parallel linkage assembly with the latter. Clutch element 206 is in engagement during the incremental lifting sequence as will be explained, and serves to transmit torque through the link 214 for elevating shaft 194 and thereby shelf 58 as needed.

A conventional gear reducer assembly 218 is included with drive means 202. Sprocket 212 is coupled to the output shaft of reducer 218 by means of a chain 220. On the other hand, clutch element 208 is mounted on the input shaft of the reducer 218, and is connected to motor 204 through a drive belt 222. When clutch element 208 is engaged, power is transmitted through the gear reducer for multiplying torque, and thence through chain 220. In preferred forms, motor 204 is constantly running during the operation of apparatus 20, and vertical movement of the shelf 58 is controlled through the clutch elements 206 and 208.

In this regard, elevating assembly 28 further includes means for engaging clutch element 208 in response to removal of individual articles from the stack 52 supported by shelf 58. This clutch-engaging means includes a conventional limit switch 224 which is disposed above shelf 58 (see FIG. 9) and is coupled by conventional circuitry (not shown) to the clutch element 208. In general, when the topmost article of the stack 52 engages the operating arm of switch 224, clutch element 208 is disengaged and no torque is transmitted through the drive assembly; on the other hand, when the topmost article is removed from the stack, switch 224 operates to effect engagement of clutch 208 to thereby transmit torque for elevating the stack. This continues until the topmost article of the stack again engages the switch 224, whereupon the latter opens to effect disengagement of clutch 208.

Means is also provided for disengaging the first clutch element 206 in response to a removal of all of the articles from the shelf 58. This structure includes a conventional photoscanner 226, along with a reflective strip 228 mounted on the upper surface of shelf 58 beneath the photoscanner. Photoscanner 226 is connected by conventional means (not shown) to clutch element 206 for disengaging the latter when radiation signals are received from the strip 228. This allows shelf 58 to descend back to the initial level thereof illustrated in FIG. 1 as will be explained.

Figure 8:
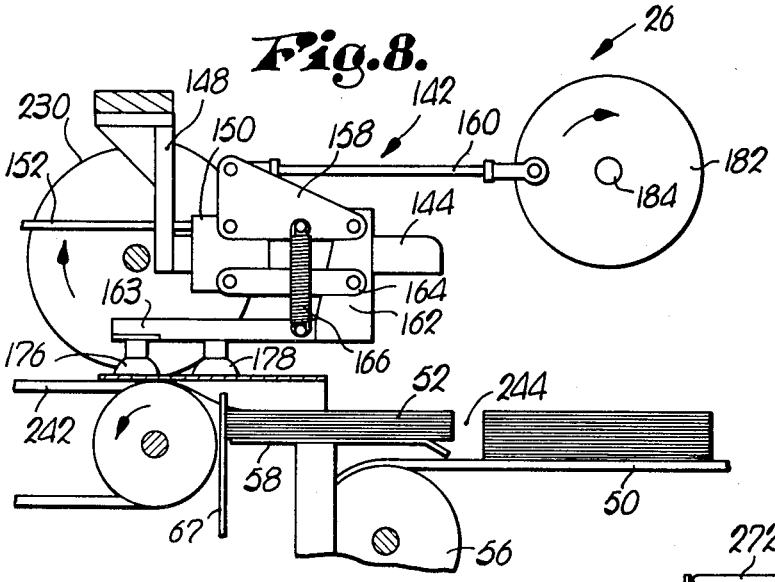
FIG. 8 is an elevational view similar to FIGS. 6–7 and illustrates the tube shifting function of the pickup mechanism.

Tube-receiving assembly 30 includes a pair of laterally spaced, tube-engaging sector wheels 230, along with a multiple belt-conveying assembly broadly referred to by the numeral 232. Referring specifically to FIG. 3, it will be seen that the wheels 230 are mounted on a common, transversely extending shaft 234 which is in turn rotatably supported by conventional bearings 236 mounted on the sidewalls 130. The uppermost end of shaft 234, as viewed in FIG. 3, is provided with a sprocket 238. Timing chain 192 is trained around sprocket 138 for timed rotation of the wheels 230 in relation to that of drive wheel 182. As best seen in FIG. 8, the radially enlarged tube-engaging portions 240 of the respective wheels 230 are timed to cooperate with the spaced belts 242 of the assembly 232 to form nip areas engaging and receiving tubes fed successively into the nip areas.

Figure 6:
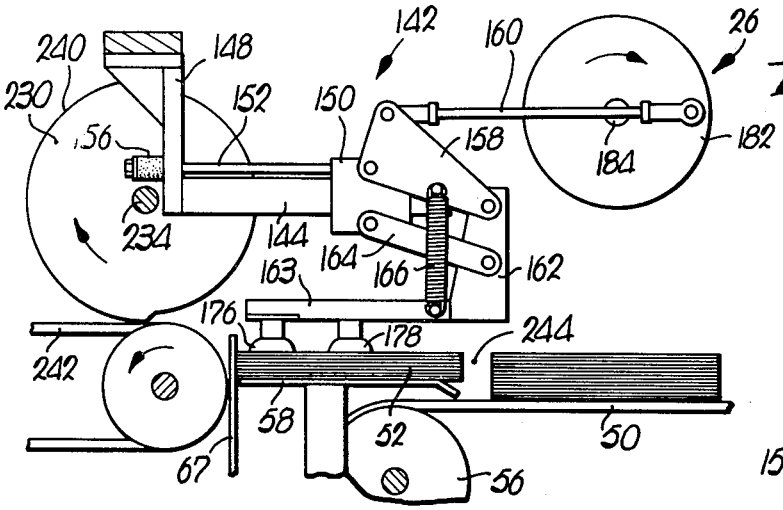
FIG. 6 is a side elevational view with parts removed for clarity illustrating the operation of the tube-gripping mechanism in initially contacting the topmost tube of a stack.

The operating sequence of preferred apparatus 20 will next be described in detail. Assuming first of all that a stack 52 of gusset tubes or other like articles is correctly positioned within station 24 and supported by shelf 58, the following occurs. First (see especially FIGS. 6–8), tube lifting and shifting structure 26 comes into play. This involves powered rotation of crank wheel 182 through shaft 184, which in turn causes circular movement of the end of drive arm 160 connected to wheel 182. This motion is transmitted to the linkage elements 158. Block 150 thereby moves along bar 144, and the elements 158 remain horizontally disposed until resilient pad 156 on guide arm 152 abuts support structure 148. At this point the roller 168 has cleared the end of bar 144, and continued rotation of wheel 182 causes the elements 158 to pivot downwardly and assume the oblique orientation depicted in FIG. 6. In this lowermost position, the respective vacuum grippers 176 and 178 contact the topmost article of the stack 52 for gripping the same. It is to be noted in this respect that the vertical shifting movement of the arm 162 is such that the vacuum grippers descend between the tube-engaging bars 138. The vacuum drawn through the grippers causes the latter to grip the topmost tube at the central area thereof.

Figure 7:
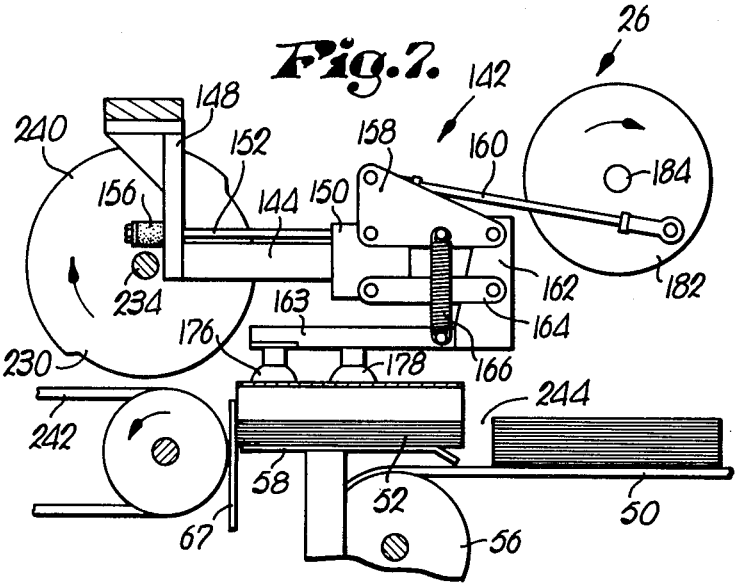
FIG. 7 is an elevational view similar to FIG. 6 but showing the pickup operation of the tube-gripping mechanism.

Continued rotation of drive wheel 182 (FIG. 7) causes movement of the elements 158 to a substantially horizontal position as illustrated in FIG. 7. In this case, the gripped topmost tube is pulled essentially straight upwardly along with the L-shaped arm 162. This simultaneously causes the gripped tube to engage the spaced arms 138, and particularly the undersides of the horizontal portions 140 thereof. Such an elevation of the central area of the gripped tube between the bars 138 causes a bowed section to be positively formed in the gripped tube. Attention is especially directed to FIG. 9 wherein this bow is clearly shown. Note also in this respect that the central bowed section is elevated to a point shown above the intermediate stop 67.

Further rotation of drive wheel 182 causes the elements 158, block 150 and L-shaped arm 162 to shift forwardly along the length of the bar 144. This operation is illustrated in FIG. 8. Such shifting causes the bowed, gripped tube to be shifted toward the nip areas presented by the respective sector wheels 230 and the cooperating belts 242. The rotation of the sector wheels 230 is timed by means of chain 192 relative to the rotation of drive wheel 182, so that when the bowed, gripped tubes are shifted, the radially enlarged sections 240 thereof grip the tubes and pull them from the vacuum grippers. This is specifically shown in FIG. 8, where it will be seen that these radially enlarged portions cooperate, along with the belts 242, in pulling the gripped and bowed tube from the grippers 176 and 178. On the other hand, the radially contracted regions of the wheels 230 permit initial insertion of the edge of the tubes during the feeding operation in order to facilitate the same.

It will further be understood that continued rotation of the drive wheel 182 in the clockwise direction illustrated will cause a reverse shifting of the elements 158, block 150 and arm 162 back along the length of slide bar 144. This reverse shifting will continue until the arm reaches the position depicted in FIG. 6, whereupon the above described lifting and feeding operation will be repeated.

The operation of elevating assembly 28 comes into play during the shifting of the topmost gripped tube as explained above. This occurs when the gripped tube is shifted from engagement with the actuating arm of limit switch 224. This element senses the removal of the gripped topmost tube and signals clutch element 208 for engagement thereof. This in turn serves to transmit power from the motor 204 (which is preferably a constantly running, high-speed electric motor) through the gear reducer and chain 220. As a consequence of this, torque is transmitted through the normally engaged clutch element 206, shaft 210, and link 214, in order to elevate shaft 194. This causes the shelf 58, and thereby the stack 52 supported thereby, to raise until the topmost tube of the stack comes again into engagement with the limit switch 224. At this point, the switch opens and causes disengagement of clutch 208, so that motor 204 simply idles and the vertical movement of shelf 58 stops. Unintended downward movement of shelf 58 and section 200 is prevented by means of the operative coupling between link 214, shaft 210, engaged clutch element 206, chain 220 and gear reducer 218.

This incremental upward shifting of the shelf 58 continues as successive articles are removed from the stack within the pickup station 24. In each instance, the topmost article of the stack is moved to the desired pickup level, so as to permit successive pickup and shifting of the article by the structure 26.

When the stack of articles is fully depleted, the following occurs. First, photoscanner 226 detects the free space radiation signals from the strip 228. The photoscanner then operates to disengage clutch element 206, which thus permits shaft 194 and shelf 58 to descend under the influence of gravity back to the initial stack-receiving position thereof illustrated in FIG. 1.

Emptying of station 24 of tubes also causes the stack-conveying assembly 22 to operate. Specifically, limit switch 126 closes in response to the complete absence of articles within station 24, and this serves to operate piston and cylinder assembly 120 in order to extend the piston rod 122. This in turn causes counterclockwise movement of the roller chain 106 around the respective sprockets 108, 110 and 112. At the same time, roller chain assembly 98 is caused to rotate since the sprocket 112 is coupled to the shaft 105 supporting the sprocket 102. Similarly, one-way clutch element 116 serves, in this mode of travel, to transmit a driving force through the pulley 56 for rotation of the tube-supporting and conveying belts 50. As can be appreciated, this in turn causes the leading stack **52*a* of tubes (see FIGS. 1 and 10) to be shifted forwardly and onto the shelf 58. This movement is continued until the forwardmost edge of the stack engages limit switch 126, whereupon further extension of the rod 122** is stopped.

During the above described general sequence, however, pusher mechanism 74 also operates. The rest position of mechanism 74 is as illustrated in FIG. 1, with the spaced arms 90 thereof extending upwardly through the slots 48 and adjacent the rearmost operating edge of the stack **52*a*. By virtue of the fact that the stacks are normally closely spaced on the belts 50, it will be seen that the arms 90 serve to elevate the second stack 52*b* in the series thereof. In any event, in this position the arms 90 are located for engaging the stack 52*a* when assembly 74 is shifted along the length of bar 68. For this purpose, the respective roller chain assemblies 98 and 106 are constructed such that pusher assembly 74 travels at a different, somewhat faster rate of speed than the belts 50. This relationship is established through the size relationship between the sprockets 110 and 112, as will be readily apparent. In preferred forms, the respective rate of travel of pusher mechanism 74 and belts 50 are such that the arms 90 firmly push the leading stack 52***a* into station 24 and into engagement with switch 126. At the same time, the next leading stack in the series comes into engagement with the trailing faces of the arms 90. This creates a space 244 between the stacks 52*a* and 52*b* and thereby ensures that there will be no interference between the stacks during subsequent pickup and handling operations.

When the leading stack 52*a* is fully positioned within the station 24, the switch 126 operates to actuate piston and cylinder assembly 82 for lowering the arms 90 out of engagement with the stack 52*a* and below the belts 50. This retracted position of the arms 90 is illustrated in phantom in FIG. 10. After retraction of the arms 90, the piston and cylinder assembly 120 is actuated for retracting the rod 122. This has the effect of moving the chain 118 in a clockwise direction which, in turn, causes the chain 104 to move in a clockwise direction and thereby shift the retracted pusher assembly 74 rearwardly to a point below and somewhat behind the rearward operating edge of the next leading stack (which would be stack 52*b* since stack 52*a* is now in the station 24). However, during this clockwise movement of chain 118, clutch element 116 slips and accordingly no torque is transmitted to shaft 57. Thus, the belts 50 do not move during this operational sequence. Piston rod 122 retracts in the manner described until limit switch 128 is contacted. At this point the piston cylinder assembly 82 is actuated for elevating the pusher arms 90 through the slots 48. This causes the pusher assembly 74 to reassume its rest position adjacent the rearward edge of the leading stack, as best seen in FIG. 1. At this point the tube-gripping and shifting structure 26 can operate in the manner described to lift and shift the gusset tubes, and the remainder of the apparatus is reset for an additional cycle.

Particular operational features of apparatus 20 include the ease with which stacks of flexible articles such as gusset tubes can be handled at high rates of speed. Noteworthy in this respect is the provision of the tube-engaging bars 138 which, in cooperation with the described lifting structure, serve to positively form a desirable bow in the respective tubes, which in turn prevents sagging thereof. Furthermore, shifting of the tubes in a bowed condition over the central upright stop 67 effectively prevents an adhering, underlying tube from being shifted with the gripped, topmost tube. This feature is important in preventing jam-ups of the overall apparatus.

Likewise, the completely automated stack-conveying assembly 22 and elevating assembly 28 greatly facilitate high speed tube handling. In this connection the unique double clutch assembly 28 provides precise vertical control of the stacks, without the necessity of constant operator supervision. Moreover, conveying assembly 22 serves to feed individual stacks to the pickup station 24 while at the same time creating a desirable space between the leading stack and that next adjacent to the pickup station. As explained, all of these features cooperate to give apparatus 20 highly advantageous operational characteristics.

It will also be appreciated that numerous variations can be made in the specific structure of apparatus 20. Two such alterations will be briefly described, wherein like parts will be labeled with like reference numerals.

Attention is first directed to FIG. 14 which schematically illustrates an alternative drive means 96*a* for the conveying assembly 22. In this case a conventional sprocket 246 is mounted directly onto shaft 57, and is coupled by means of chain 248 to a drive pulley 250. The latter is operably connected to motor means (not shown) for intermittent shifting of the stacksupporting belts 50. Furthermore, in this case a chain 118*a* is trained around sprockets 112*a* and 108*a* as illustrated, but the chain 118*a* is independent of shaft 57. In essence, this embodiment simply provides independent drives for the belts 50, and for the pusher mechanism 74.

Another alternative is illustrated in FIG. 12 and involves a pusher mechanism 74*a*. In this instance the mechanism 74*a* includes an upper and lower plate 76*a* and side plate 78*a*. As illustrated, the respective plates are disposed around slide bar 68. A depending connector element 252 is connected to the lowermost plate 76*a* and is adapted to be connected with the ends of roller chain 104. A pair of conventional pneumatic piston and cylinder assemblies 254 are coupled to uppermost plate 76*a* and include respective, selectively extensible piston rods 256. These arms are located for extending upwardly through the slots 48 in order to abut the rearmost operating edge of the stacks. In all other respects, the mechanism 74*a* is equivalent to the previously described pusher mechanism, but as can be appreciated it is somewhat simpler in design.

Figure 15:
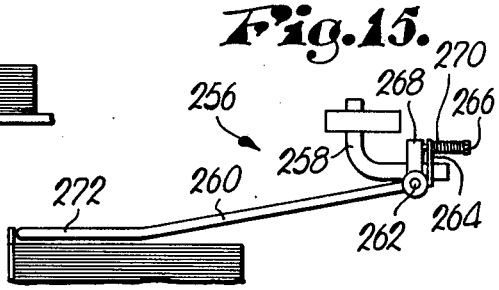
FIG. 15 is a fragmentary side elevational view with parts omitted for clarity of another type of tube-engaging breaker bar assembly.

Finally, FIG. 15 illustrates an especially useful form of a tube-engaging breaker bar. Specifically, the assembly 256 includes stationary mounting structure 258 along with a spring loaded, tube-engaging bar 260. Bar 260 is pivotally mounted on a transverse pin 262, and includes an upstanding segment 264. An elongated, threaded bolt 266 extends through segment 264 and into the stationary block 268 forming a part of the mounting structure 258. A biasing spring 270 is interposed between the head of bolt 266 and segment 264, and serves to bias the tube-engaging arm downwardly. As illustrated in FIG. 15, the arm 260 preferably includes a generally horizontally disposed portion 272 which is in actual engagement with the topmost tube of the stack being handled. It will also be appreciated that a pair of laterally spaced, spring loaded bars 260 are provided, just as in the above described embodiment, for the purpose of cooperating with the tube-lifting structure for forming a bow in each tube during handling thereof. This type of spring loaded breaker bar assembly has proven to be very effective in eliminating gusset tube sagging, and in many instances is preferred.

It should also be understood that the successive stacks of articles handled by the apparatus of the present invention need not be in abutting end-to-end relationship as illustrated in FIG. 1. Specifically, the stacks may be overlapped or "shingled" on the conveying structure, which serves to increase the overall capacity of the machine. In this connection, the lifting and separating function of the pusher member 74 described hereinabove is fully operable with overlapped or shingled stacks, so that the important feature of providing an operating space between the stacks as they are fed is maintained.

Having thus described the invention, what is claimed as new and desired to be secured by Letters Patent is:

1. Apparatus for individually and sequentially shifting flat tubes or the like from a stack thereof at a pickup station, comprising:

structure presenting a pair of elongated, spaced, tube-engaging surfaces above said pickup station; and means for individually picking up said tubes from said stack and shifting the tubes from the pickup station, including at least one tube-gripping element located above said station; and mechanism operatively coupled to said element for selectively lowering the latter between said surfaces for gripping of the topmost tube of said stack at the central area of the tube, for raising the element and gripped tube together in order to cause the latter to engage said surfaces on opposite sides of said central area for creating a bowed section in said tube and preventing sagging thereof, and for shifting said tube while maintaining operative engagement between said tube and surfaces, said mechanism comprising an elongated slide bar;

a member slidably mounted on said bar for back and forth movement thereon, linkage means pivotally connected to said slidable member and element-supporting means;

drive means including a drive wheel rotatable about a generally horizontal axis which is transverse to the longitudinal axis of said bar, and a rigid drive arm pivotally secured at the opposed ends thereof to said linkage means and to said driving wheel, said linkage means including structure for, in response to rotation of said drive wheel, sequentially lowering said tube-supporting means and tube-gripping element to allow the latter to grip said topmost tube, for raising the tube-supporting means, tube gripping element and gripped tube, and for shifting said slidable member, tube-gripping means and gripped tube along the length of said slide bar; and motion limiting means including an elongated rod element extending generally along the length of said slide bar and having one end thereof secured to said slidable member, the opposite end of said rod element being adapted for contacting stationary structure for limiting the travel of said slidable member, there being means for adjusting the effective length of said rod element.

2. The invention of claim 1, wherein said tube-engaging surfaces are essentially equally spaced vertically from the topmost tube and disposed substantially parallel to the latter.

3. The invention of claim 2, wherein said engaging surfaces respectively comprise stationary, elongate members disposed in laterally spaced relationship and essentially parallel to each other.

4. The invention of claim 2, wherein said engaging surfaces respectively comprise spring loaded downwardly biased arms disposed in laterally spaced relationship and essentially parallel to each other.

5. The invention of claim 1 including structure for abutting said stack and normally preventing said shifting movement of said tubes until the latter are bowed.

6. The invention of claim 5, wherein said element comprises an air suction device adapted for coupling with air pumping means for exerting a gripping force on the topmost tube by reducing air pressure over at least portions of the central area of the tube surface.

7. The invention of claim 1, including:

retaining means adjacent said pickup station including upright structure adapted to abut at least portions of one side of the stack for normally preventing shifting of the tubes, said upright structure being located and of a height for allowing the bowed section of a gripped tube to pass thereover.

8. The invention of claim 7, wherein said retaining structure includes:

at least one upright retaining element having a portion thereof engageable with one side of the stack adjacent said central areas of the tubes, said retaining element having at least a portion of the upper extremity thereof disposed between said tube-engaging surfaces.

9. The invention of claim 1, including:

means for shiftably supporting the stack at the pickup station, said shiftable supporting means including vertically movable structure for successively elevating the stack as the topmost tubes are removed therefrom.

10. Apparatus for selectively elevating a stack of articles from an initial level as articles are removed from the stack for maintaining the topmost article at a desired pickup level, said apparatus comprising:

structure defining a pickup station for supporting said stack of articles and which is shiftable in an upward direction from said initial level and shiftable downwardly back to said initial level;

selectively actuatable drive means operatively coupled to said station-defining structure for selective elevation of the latter, said drive means including a first, normally engaged, force-transmitting clutch element having an output drive member operably coupled thereto;

means operatively coupled to said first clutch element for preventing downward movement of said stationdefining structure when the first element is engaged, said movement-preventing means including linkage means having mechanism pivotally connected to said station-defining structure and coupled with said output drive member;

a drive assembly including motor means coupled to said first clutch element;

means for commencing the operation of said drive assembly in response to removal of at least one of said articles from said stack for elevating the station-defining structure, and for stopping the operation of said drive assembly to stop the elevation of said stack when the topmost article thereof reaches said pickup level, and said pivotally connected mechanism serving to transmit force from said drive assembly during operation of the latter to upwardly shift said station structure, and to allow said station-defining structure to shift downwardly when said first clutch element is disengaged;

means for disengaging said first clutch element in response to a removal of all of the articles of said stack for allowing said station-defining structure to descend to said initial level.

11. The invention of claim 10, wherein:

said pickup station structure includes an elongate, upright member, said output drive member comprising a rotatable shaft, and said linkage means including a link element coupled with said shaft and connected to said upright member for translating rotary force delivered by said shaft to produce translatory shifting of said upright member.

12. Apparatus as set forth in claim 10 wherein said operation-commencing means comprises a second force-transmitting clutch element operatively coupled between said motor means and first clutch element.

13. The invention of claim 12, wherein said means for preventing downward movement of station-defining structure is operably coupled between said first and second clutch elements and comprises a gear train device operable to multiply and transmit force produced by said motor means from said second clutch element when the latter is engaged to said first clutch element.

14. The invention of claim 12, wherein said means for engaging said second clutch element includes:

means disposed adjacent said pickup station for sensing the presence of said topmost article at said pickup level, said sensing means including switch means operably coupled with said second clutch element for controlling engagement of the latter when the topmost article is at a level below said pickup level.

15. The invention of claim 10, wherein said means for disengaging said first clutch element includes:

means for sensing the presence of articles at said pickup station, said sensing means including switching means operably coupled with said first clutch element for disengaging the latter when the stack of articles at said pickup station is fully depleted.

16. The invention of claim 15, wherein said sensing means comprises:

means disposed beneath said stack for delivering free-space radiation signals upwardly toward the top of said stack, said articles normally blocking delivery of said signals upwardly, and means disposed above said stack for receiving said signals when the last article is removed from the pickup station to thereby sense the depletion of said stack.

17. Apparatus for handling a series of stacks of articles disposed in generally aligned and closely spaced relationship, and for successively shifting the leading stack thereof into a receiving station, said apparatus comprising:

a stack-receiving station;

means adjacent said station for successively removing articles from the stack thereof within said station;

station-shifting means operatively coupled to said station for incrementally shifting said station upwardly in response to removal of the topmost article from the stack within said station in order to elevate the stack such that the next article thereof is at a level for removal by said article-removing means, and for lowering said station to a starting level after all the articles of said stack have been removed to permit the station to receive the next stack in said series thereof;

means for supporting said series of stacks and including means for incrementally shifting of said series of stacks forwardly towards said station at a first rate of travel;

a shiftable pusher member disposed, in the rest position thereof, in an upright orientation adjacent the rear edge of said leading stack, the upper end of said pusher member being configured for engaging and lifting the next stack immediately behind said leading stack for allowing said member to assume said rest position in the event that said leading stack and said next stack are located close together;

means for shifting said pusher member forwardly along a path to push said leading stack into said station and for returning said pusher member to said rest position thereof;

sensing means operably coupled with said apparatus for sensing the absence of articles in said station, and, in response thereto (1) activating said station shifting means to lower said station to said starting level;

(2) activate said incremental shifting means for shifting said series of stacks towards said station until the leading stack thereof is disposed within the station;

(3) terminating the movement of said series of stacks when said leading stack is disposed within said station;

(4) activating said pusher-shifting means during at least a part of said incremental shifting of said series of stacks and at a second rate of travel correlated to said first rate of travel for creating a space between said leading stack, when the latter is disposed within said station, and said next stack immediately therebehind; and (5) thereafter returning said pusher member to said rest position thereof, and terminating the movement of said pusher member.

* * * * *